US009732743B2

(12) United States Patent
Chien et al.

(10) Patent No.: US 9,732,743 B2
(45) Date of Patent: Aug. 15, 2017

(54) PNEUMATIC MICROPUMP

(75) Inventors: Liang-Ju Chien, Kaohsiung (TW); Chi-Han Chiou, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 876 days.

(21) Appl. No.: 13/463,786

(22) Filed: May 3, 2012

(65) Prior Publication Data

US 2013/0058805 A1 Mar. 7, 2013

(30) Foreign Application Priority Data

Sep. 7, 2011 (TW) ..... 100132197 A

(51) Int. Cl.

| | |
|---|---|
| ***F04B 43/04*** | (2006.01) |
| ***F04B 43/113*** | (2006.01) |
| ***F04B 43/02*** | (2006.01) |
| ***F04B 53/10*** | (2006.01) |
| ***F04B 53/12*** | (2006.01) |

(52) U.S. Cl.

CPC ..... *F04B 43/043* (2013.01); *F04B 43/02* (2013.01); *F04B 43/028* (2013.01); *F04B 43/1133* (2013.01); *F04B 53/1037* (2013.01); *F04B 53/129* (2013.01)

(58) Field of Classification Search

CPC ..... F04B 43/073; F04B 43/043; F04B 43/02; F04B 43/1133; F04B 43/028; F04B 53/1037; F04B 53/129

USPC ..... 417/395, 394

See application file for complete search history.

(56) References Cited

U.S. PATENT DOCUMENTS

| | | | | |
|---|---|---|---|---|
| 4,158,530 | A * | 6/1979 | Bernstein | 417/389 |
| 5,088,515 | A * | 2/1992 | Kamen | 137/15.17 |
| 6,398,760 | B1 | 6/2002 | Danby | |
| 6,408,872 | B1 | 6/2002 | Skeens et al. | |

(Continued)

FOREIGN PATENT DOCUMENTS

| | | |
|---|---|---|
| CN | 1926336 A | 3/2007 |
| TW | 574131 B | 2/2004 |

(Continued)

OTHER PUBLICATIONS

Bonnie Tingting Chia et al., "A Novel Thermo-Pneumatic Peristaltic Micropump with Low Temperature Elevation on Working Fluid," Sensors and Actuators A, Mar. 2010, pp. 86-93, vol. 165, Elsevier, US.

Junhui Ni et al.,"A Planar PDMS Micropump Using in-Contact Minimized-Leakage Check Valves," Journal of Micromechanics and Microengineering, Aug. 2010, 7 pages, vol. 20, IOP Publishing, US.

(Continued)

*Primary Examiner* — Devon Kramer
*Assistant Examiner* — Lilya Pekarskaya

(57) ABSTRACT

A pneumatic micropump is provided. The pneumatic micropump includes a fluidic channel layer, an upper substrate, a lower substrate, an upper membrane and a lower membrane. The fluidic channel includes a fluid inlet a reservoir, and a fluid outlet, wherein the fluid passes through the fluid inlet, the reservoir and the fluid outlet, successively. The upper substrate includes an upper pneumatic chamber facing the reservoir. The lower substrate includes a lower pneumatic chamber facing the reservoir. The upper membrane is disposed between the upper pneumatic chamber and the reservoir, and the lower membrane is disposed between the lower pneumatic chamber and the reservoir.

17 Claims, 13 Drawing Sheets

(56) References Cited

U.S. PATENT DOCUMENTS

| | | | | |
|---|---|---|---|---|
| 6,619,311 | B2 * | 9/2003 | O'Connor | B01L 3/5025 137/109 |
| 7,284,966 | B2 * | 10/2007 | Xu et al. | 417/395 |
| 7,445,926 | B2 | 11/2008 | Mathies et al. | |
| 7,832,429 | B2 * | 11/2010 | Young et al. | 137/829 |
| 8,323,586 | B2 * | 12/2012 | Zhou et al. | 422/502 |
| 8,584,703 | B2 * | 11/2013 | Kobrin et al. | 137/597 |
| 8,646,482 | B2 * | 2/2014 | Zhou | B01F 5/0683 137/829 |
| 2004/0209354 | A1 * | 10/2004 | Mathies et al. | 435/287.2 |
| 2008/0077068 | A1 * | 3/2008 | Orr | F04B 7/02 604/6.11 |

FOREIGN PATENT DOCUMENTS

| | | | |
|---|---|---|---|
| TW | 585836 | B | 5/2004 |
| TW | I255315 | | 5/2006 |
| TW | I269776 | | 1/2007 |
| TW | I306490 | | 2/2009 |
| TW | 200924849 | A | 6/2009 |
| TW | 201014977 | | 4/2010 |
| TW | 201020544 | A | 6/2010 |
| TW | 201024205 | | 7/2010 |
| TW | I347223 | | 8/2011 |

OTHER PUBLICATIONS

Yi-Ning Yang et al., "A Pneumatic Micropump Incorporated with a Normally Closed Valve Capable of Generating a High Pumping Rate and a High Back Pressure," Microfluid Nanofluid, Oct. 2008, pp. 823-833, Springer, US.

Chun-Wei Huang et al., "Pneumatic Micropumps with Serially Connected Actuation Chambers," Journal of Micromechanics and Microengineering, Sep. 2006, pp. 2265-2272, vol. 16, IOP Publishing, US.

Wook Park et al., "Fabrication of Membrane-Type Microvalves in Rectangular Microfluidic Channels via Seal Photopolymerization," Lab Chip, Aug. 2010, pp. 2814-2817, The Royal Society of Chemistry, US.

Hoyin Lai et al., "Design and Synamic Characterization of "Single-Stroke" Peristaltic PDMS Micropumps," Lab Chip, Oct. 2010, pp. 336-342, The Royal Society of Chemistry, US.

Tai-Yan Ye et al., "The Study and Design of the New Membrane-Based Pneumatic Micro-Pump," A Thesis, Jun. 2008, 77 pages, Taiwan.

Taiwan Patent Office, Office Action, Patent Application Serial No. 100132197, Oct. 29, 2013, Taiwan.

A. Olsson et al., "A Valve-Less Planar Fluid Pump with Two Pump Chambers," Sensors and Actuators, Mar. 1995, pp. 549-556, vol. 47, Elsevier, US.

* cited by examiner

PNEUMATIC MICROPUMP

CROSS REFERENCE TO RELATED APPLICATIONS

This Application claims priority of Taiwan Patent Application No. 100132197, filed on Sep. 7, 2011, the disclosure is hereby incorporated by reference herein in its entirety.

TECHNICAL FIELD

The present invention relates to a pneumatic micropump, and in particular relates to a pneumatic micropump which is operated by pressure change.

BACKGROUND

Analgesics are often prescribed to relieve post-operative pain. In recent years, there has been considerable activity directed to methods which permit a patient to receive analgesics in proper doses and at right time so as to effectively decrease the pain that the patient feels.

Infusion pumps are used to administer liquid drugs to patients. The liquid drug is supplied from a drug reservoir and delivered to the patient via an infusion pump. Based on different requirements, the infusion pump can operate in different modes of infusion, such as a pain controlled analgesic (hereinafter PCA) mode. In the PCA mode, the pump is operated to deliver a dose of analgesic to a patient in response to the request by the patient.

The PCA delivery system has a number of advantages including: (1) patients receive medicine when they need it, instead of having to wait for a medical person; (2) time is saved between when the patient feels the pain and when the drug is administered; and (3) a patient receives a proper dose of analgesic, and thus the patient feels less pain. Therefore, reduce the possibility of complications resulting from the pain.

Much research has been done on pneumatic injection micropump:

U.S. Pat. No. 6,408,878 discloses a normally closed type microfabricated elastomeric valve including an elastic microstructure with a width less than 1000 μm, a controlling channel, and a fluidic channel. The elastic microstructure in the fluidic channel is used to block the fluidic channel. While the controlling channel is in a negative status, the elastic microstructure is directed into the controlling channel to allow fluid to pass therethrough. Between closing and opening of the elastic microstructure, it is necessary for the elastic microstructure to deflect the distance of the width of the fluidic channel.

U.S. Pat. No. 7,445,926 provides a fluid control structure in a micro fluid device, which includes a fluidic base plate, a glass substrate and an elastomeric membrane valve disposed between the fluidic base plate and the glass substrate. Due to the elastic nature of the elastomeric membrane, a flowing path of the fluidic layer is normally closed. When a negative pressure is formed in the glass substrate, the elastomeric membrane is directed into a pneumatic manifold of the glass substrate so as to allow fluid to flow thereacross.

Taiwan Patent 1269776 provides a driving microfluid device, which includes a continuously curved pneumatic channel, a membrane and a fluidic channel, wherein the pneumatic channel and the fluidic channel is respectively disposed on the opposing side of the membrane. At the intersection of the pneumatic channel and the fluidic, the membrane is deformed due to the pressure difference, and the fluid is pushed into the fluidic channel.

In the thesis "The study and design of the new membrane-based pneumatic micro-pump" from I-Shou University of Taiwan, a double sided mode peristaltic pump is disclosed, which includes a fluidic channel and a plurality of pairs of side chambers disposed at two opposing sides of the fluidic channel. Actuated by pressure varied in the side chambers, the fluidic channel is deformed to generate transportation of a sample stream. However, to close the fluidic channel efficiently, the pressure applied to the side chamber is large.

SUMMARY

This invention overcomes a drawback, wherein the membrane of a conventional pneumatic micropump is broken or elastic fatigue due to large deflection. This invention solves problems such as inverse flow or dead volume in the fluidic channel of the conventional pneumatic micropump. This invention also provides a highly sensitive pneumatic micropump which is operated in an efficiency way.

In order to realize the above features, a pneumatic micropump is provided, which includes a fluidic channel layer, an upper substrate, a lower substrate, an upper membrane and a lower membrane. The fluidic channel includes a fluid inlet a reservoir, and a fluid outlet, wherein the fluid passes through the fluid inlet, the reservoir and the fluid outlet, successively. The upper substrate includes an upper pneumatic chamber facing the reservoir. The lower substrate includes a lower pneumatic chamber facing the reservoir. The upper membrane is disposed between the upper pneumatic chamber and the reservoir, and the lower membrane is disposed between the lower pneumatic chamber and the reservoir.

In the above embodiment, the pneumatic micropump includes a valve disposed in the fluid inlet or fluid outlet. The valve includes an embossed structure and a flap. The embossed structure is formed on a side wall of the fluid inlet or the fluid outlet, and the flap abuts the embossed structure in a separable manner. Along a direction from the fluid inlet to the fluid outlet, the embossed structure and the flap are overlapped to each other, and the embossed structure is disposed in front of the flap. The above mentioned fluid inlet and the fluid outlet are respectively defined between the fluidic channel layer and the lower membrane, and the flap is disposed on the lower membrane.

In the above embodiment, the reservoir has a flange formed between the upper membrane and the lower membrane, wherein the flange encircles an inner wall of the reservoir and has a bottom portion which is connected to the inner wall of the reservoir and a apex portion which is connected to the bottom portion, wherein the bottom portion is wider than the apex portion.

In the above embodiment, the upper membrane and the fluidic channel layer are formed integrally.

In the above embodiment, the upper membrane and the lower membrane are independently actuated by the upper pneumatic chamber and the lower pneumatic chamber, but directed into the reservoir or away from the reservoir simultaneously.

In the above embodiment, the upper pneumatic chamber and the lower pneumatic chamber respectively has a pneumatic channel connecting to an ambient, wherein the flowing directions of the flow in the pneumatic channels are perpendicular to the extension plane of the upper plane or the lower plane.

In the above embodiment, the pneumatic micropump further includes an upper guiding element and a lower guiding element, wherein the upper guiding element is disposed between the fluidic channel layer and the upper membrane, and the lower guiding element is disposed between the fluidic channel layer and the lower membrane.

In the above embodiment, the upper guiding element has a guiding inlet connected to the fluid inlet and a guiding outlet connected to the reservoir; the lower guiding element has a guiding inlet connected to the reservoir and a guiding outlet connected to the fluid outlet; and the fluid inlet, the reservoir, and the fluid outlet are formed independently in the fluidic channel layer. The upper membrane and the lower membrane are actuated by pressure difference in the upper pneumatic chamber and the lower pneumatic chamber and directed into the reservoir reciprocally.

By changing pressure difference in the pneumatic chambers of the pneumatic micropump, the upper and lower membranes are deformed so as to transport the fluid along a predetermined direction via volume changing of the reservoir. Compared with the conventional pneumatic micropump, the pneumatic micropump of the invention exhibits a better efficiency while the fluid transport rate is concerned.

BRIEF DESCRIPTION OF THE DRAWINGS

The present invention can be more fully understood by reading the subsequent detailed description and examples with references made to the accompanying drawings, wherein:

FIGS. 9A-9D show schematic views of a pneumatic micropump of a third embodiment of the invention, wherein FIG. 9A is an explosive view of the pneumatic micropump of the third embodiment of the invention, and FIG. 9D shows cross-sectional views of the pneumatic micropump of the third embodiment of the invention.

DETAILED DESCRIPTION OF THE INVENTION

Figure 1:
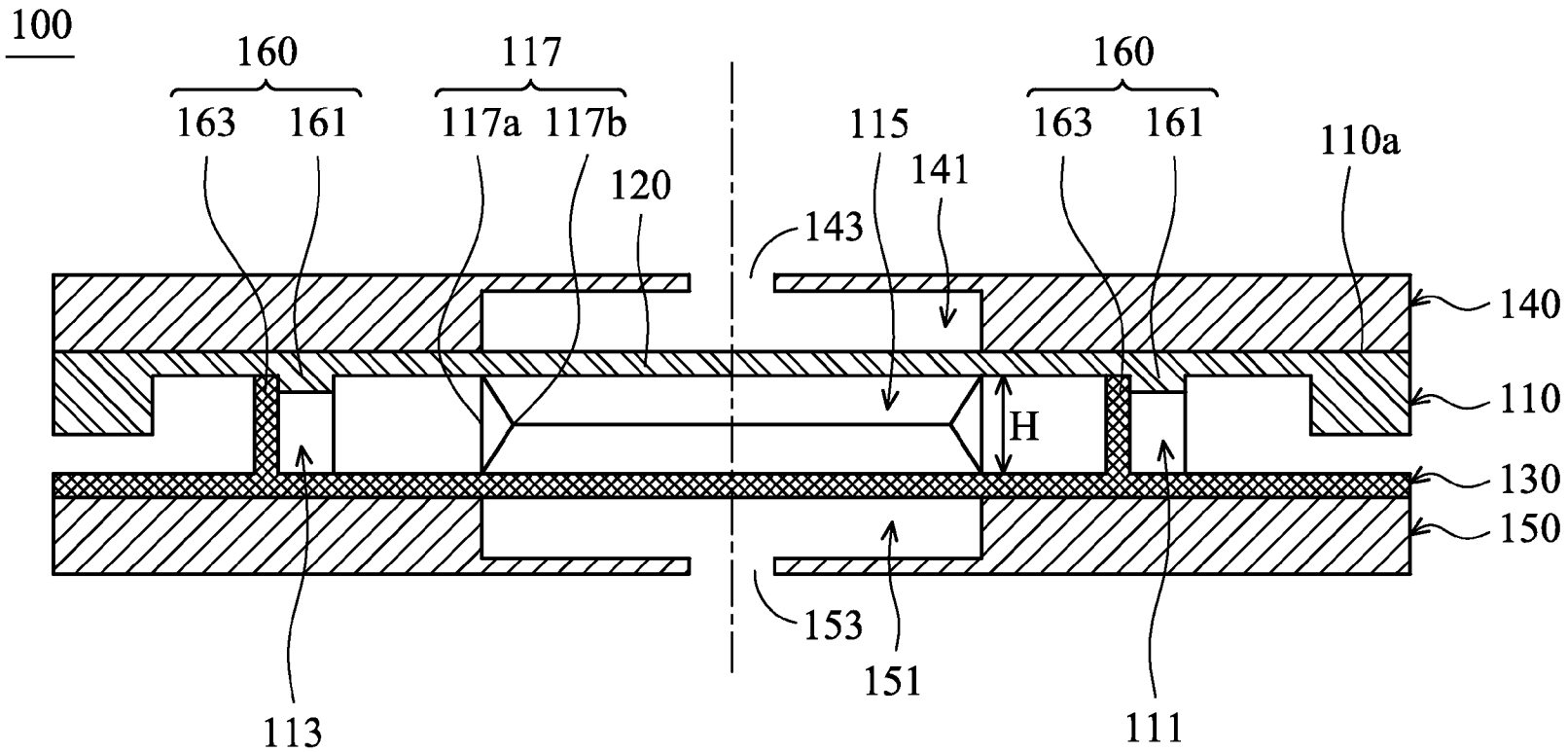
FIG. 1 shows a cross-sectional view of a pneumatic micropump of a first embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
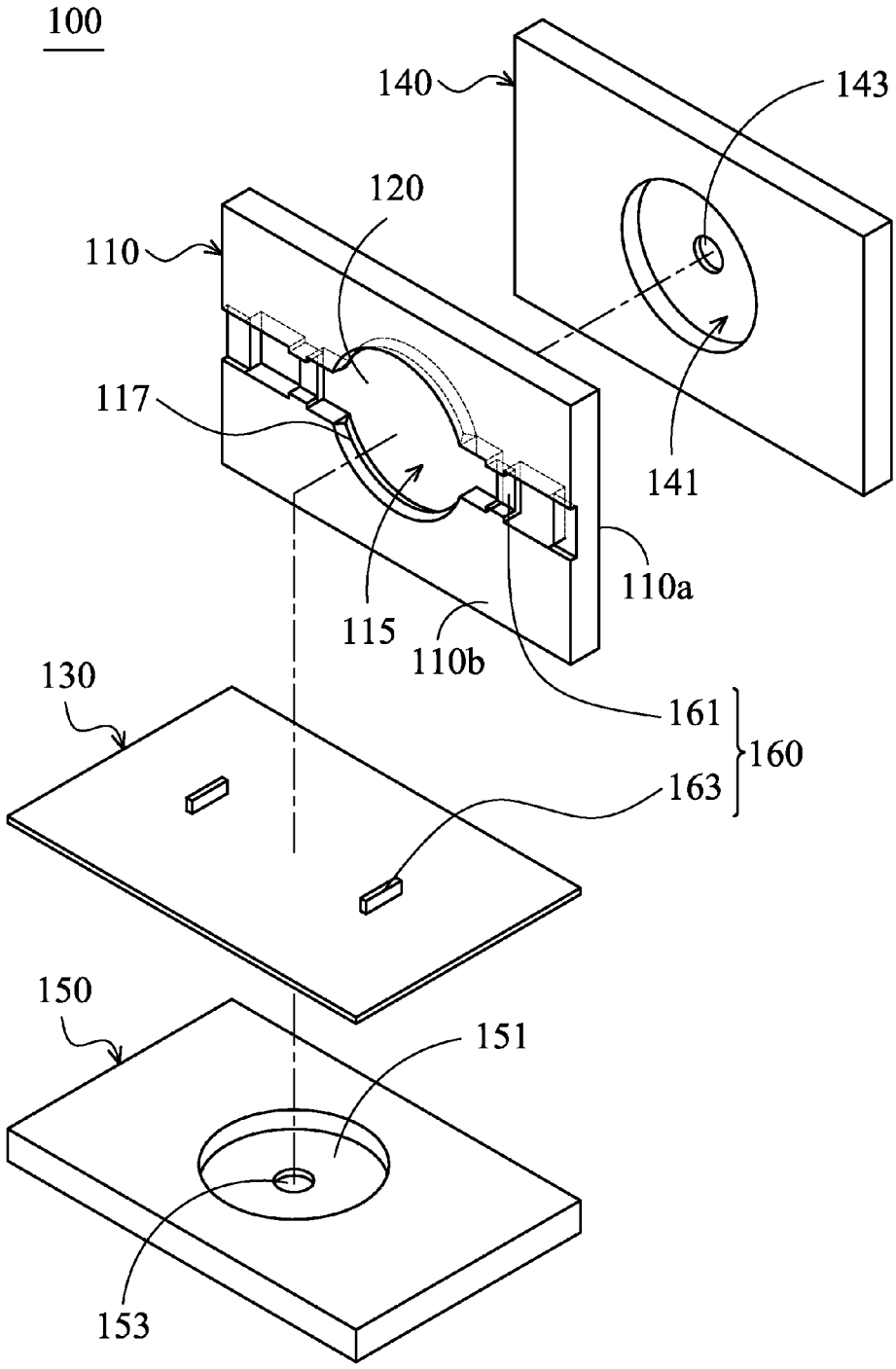
FIG. 2 is an explosive view of the pneumatic micropump of the first embodiment of the invention.

Please refer to FIGS. 1 and 2. FIGS. 1 and 2 respectively show a cross-sectional view and explosive view of a first embodiment of the invention. The pneumatic micropump 100 of the embodiment includes a fluidic channel layer 110, an upper membrane 120, a lower membrane 130, an upper substrate 140, a lower substrate 150 and two valves 160.

The fluidic channel layer 110 has an upper surface 110*a* and a lower surface 110*b* and includes a fluid inlet 111, a fluid outlet 113 and a reservoir 115. The reservoir 115 is interconnected between the fluid inlet 111 and the fluid outlet 113. In a single fluid transporting process, a fluid is flowed through the fluid inlet 111, the reservoir 115 and the fluid outlet 113, successively. The reservoir 115 is formed in a substantive center of the fluidic channel later 110. In one exemplary embodiment, the reservoir 115 is generally a circular ring, and a circular flange 117 is formed at the inner wall of the reservoir 115. The circular flange 117 has a bottom portion 117*a* connected to the inner wall of the reservoir 115 and a apex portion 117*b* connected to the bottom portion 117*a*, wherein the bottom portion 117*a* is wider than the apex portion 117*b*. In other words, along a direction from the upper surface 110*a* to the lower surface 110*b* of the fluidic channel layer 110, the width of the reservoir 115 gradually decreases and then gradually increases.

The fluid inlet 111 and the fluid outlet 113 are formed at the two sides of the reservoir 115, wherein both of the fluid inlet 111 and the fluid outlet 113 are with an U-shaped configuration. Specifically, the fluid inlet 111 and the fluid outlet 113 are a rectangular recess inwardly depressed from the lower surface 110*b* of the fluidic channel layer 110. Generally, relatively to one side of the lower surface 110*b* of the fluidic channel layer 110, the fluid inlet 111, the fluid outlet 113 and the reservoir 115 are exposed to the outside.

Facing the reservoir 115, the upper membrane 120 is disposed on the upper surface 110*a* of the fluidic channel layer 110. In the embodiment, the upper membrane 120 and the fluidic channel layer 110 are formed integrally, but it is not limited thereto (the manufacturing process of the upper membrane 120 and the fluidic channel layer 110 will be described later).

The lower membrane 130 is connected to the lower surface 110*b* of the fluidic channel layer 110 by bounding; thus relatively to one side of the lower surface 110*b* of the fluidic channel layer 110, the fluid inlet 111, the fluid outlet 113 and the reservoir 115 can be closed. In other words, the fluid inlet 111 and the fluid outlet 113 are defined between the fluidic channel layer 110 and the lower membrane 130, and the reservoir 115 is sandwiched between the upper membrane 120 and the lower membrane 130.

The upper substrate 140 is connected to the upper surface 110*a* of the fluidic channel layer 110 and includes an upper pneumatic chamber 141 and a pneumatic channel 143, wherein the upper pneumatic chamber 141 corresponds to the reservoir 115 so that the upper membrane 120 is disposed between the upper pneumatic chamber 141 and the reservoir 115. The pneumatic channel 143 is connected between the upper pneumatic chamber 141 and a peripheral device (not shown) which is used to adjust pressure in the upper pneumatic chamber 141. The flowing direction of air in the pneumatic channel 143 is substantially perpendicular to an extension plane of the upper membrane 120.

The lower substrate 150 is connected to the lower membrane 130 and includes a lower pneumatic chamber 151 and a pneumatic channel 153, wherein the lower pneumatic chamber 151 corresponds to the reservoir 115 so that the lower membrane 120 is disposed between the lower pneumatic chamber 151 and the reservoir 115. The pneumatic channel 153 is connected between the lower pneumatic chamber 151 and a peripheral device (not shown) which is used to adjust pressure in the lower pneumatic chamber 151. The flowing direction of air in the pneumatic channel 153 is substantially perpendicular to an extension plane of the lower membrane 130.

The two valves 160 are disposed in the fluid inlet 111 and the fluid outlet 113, and each of the two valves 160 respectively has an embossed structure 161 and a flap 163. The embossed structures 161 are respectively formed at the U-shaped inner wall of the fluid inlet 111 and the fluid outlet 113. The flaps 163, formed on the lower membrane 130, abut the embossed structures 161 in a separable manner. In the embodiment, the embossed structures 161 and the fluidic channel layer 110 are formed integrally, and the flaps 163 are formed at a side of the lower membrane 130 which faces the fluidic channel layer 110. The manufacturing processes and operational functions thereof will be described later.

The cross-section of regions of the fluid inlet 111 and the fluid outlet 113, where the embossed structures 161 are formed, are decreased, and the cross-section of the flap 163 substantially equals to the cross-section of the fluid inlet 111 and the fluid outlet 113. Thus, along a direction from the fluid inlet 111 to the fluid outlet 113, the embossed structure 161 and the flap 163 are overlapped to each other. It is noted that, in the fluid inlet 111, the fluid from outside successively flows though the embossed structure 161 and the flap 163 and flows into the reservoir 115. In the fluid outlet 113, the fluid from the reservoir 115 successively flows though the embossed structure 161 and the flap 163.

The manufacturing processes of the pneumatic micropump 100 of the first embodiment of the invention are described as follows. Please refer to FIGS. 3-5. FIGS. 3A-3D show manufacturing processes of the upper substrate 140 and the lower substrate 150 of the first embodiment of the invention. Because both of the upper substrate 140 and the lower substrate 150 have an identical structural feature, only the upper substrate 140 is elaborated.

Figure 3A:
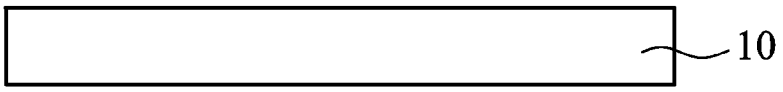
FIGS. 3A-3D show cross-sectional views of manufacturing processes of an upper substrate and a lower substrate of the first embodiment of the invention.
Figure 3B:
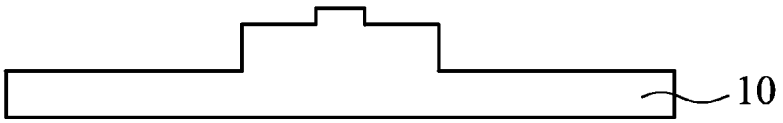
Figure 3C:
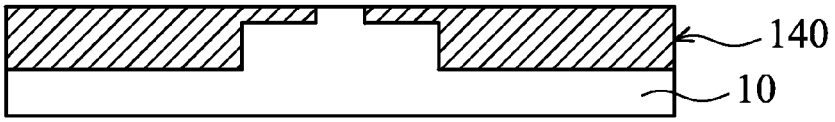
Figure 3D:
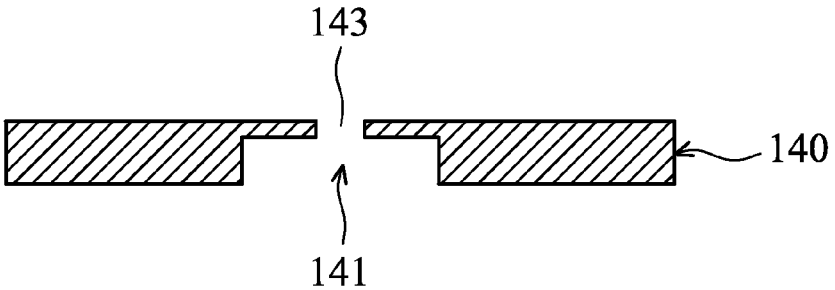

For mass production, the elements of the embodiment are manufactured by thermoforming. Thus, prior to producing the elements, processing processes of mold manufacturing are conducted. Please refer to FIGS. 3A-3D. Firstly, a mold 10 is provided as shown in FIG. 3A, wherein the mold 10 is made of glass, silicon, PMMA, etc. Next, as shown in FIG. 3B, the mold 10 is processed by engraving or exposure development and etching. Then, as shown in FIG. 3C, a thermosetting material, such as PDMS, is poured into the mold 10, and the processed upper substrate 140 is removed after solidification, as shown in FIG. 3D.

Figure 4A:
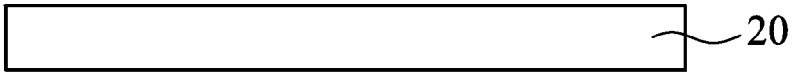
FIGS. 4A-4D show cross-sectional views of manufacturing processes of a part of the elements of the first embodiment of the invention.
Figure 4B:
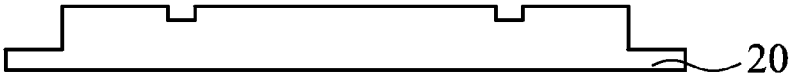
Figure 4C:
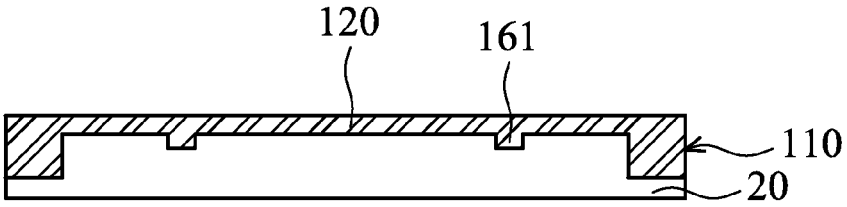
Figure 4D:
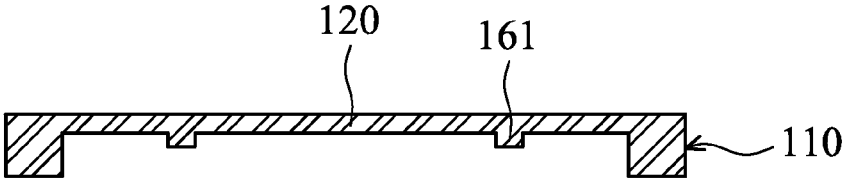

In one exemplary embodiment, the fluidic channel layer 110, the upper membrane 120 and the embossed structures 161 are formed by a single mold. Please refer to FIGS. 4A to 4D. Firstly, a mold 20 is provided as shown in FIG. 4A, wherein the mold 20 is made of glass, silicon, PMMA, etc. Next, as shown in FIG. 4B, the mold 20 is processed by engraving or exposure development and etching. Then, as shown in FIG. 4C, thermosetting material, such as PDMS, is poured into the mold 20, and after solidification the processed element, including the fluidic channel layer 110, the upper membrane 120 and the embossed structures 161, is removed, as shown in FIG. 4D.

Figure 5A:
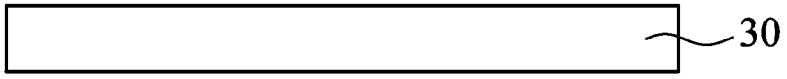
FIGS. 5A-5D show cross-sectional views of manufacturing processes of a part of the elements of the first embodiment of the invention.
Figure 5B:
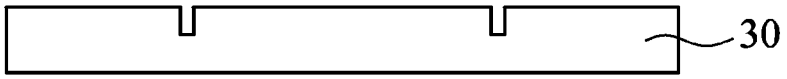
Figure 5C:
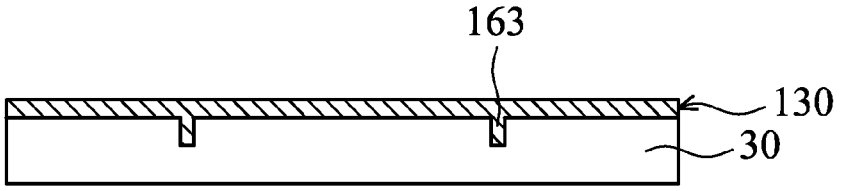
Figure 5D:
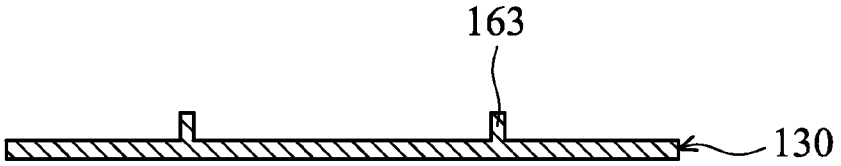

In one exemplary embodiment, the lower membrane 130 and the flaps 163 are formed by a single mold. Please refer to FIGS. 5A to 5D. Firstly, a mold 30 is provided as shown in FIG. 5A, wherein the mold 30 is made of glass, silicon, PMMA, etc. Next, as shown in FIG. 5B, the mold 30 is processed by engraving or exposure development and etching. Then, as shown in FIG. 5C, thermosetting material, such as PDMS, is poured into the mold 30, and after solidification the processed element, including lower membrane 130 and the flaps 163, is removed, as shown in FIG. 5D.

After the above mentioned processes are completed, the elements are bonded to each other, and the pneumatic micropump 100 of the first embodiment of the invention is completed. It is understood that the above mentioned processes should not be construed as being limited to the structural features of the elements of the invention, and a person skilled in the art can produce the elements by different methods according to different demands.

Figure 6:
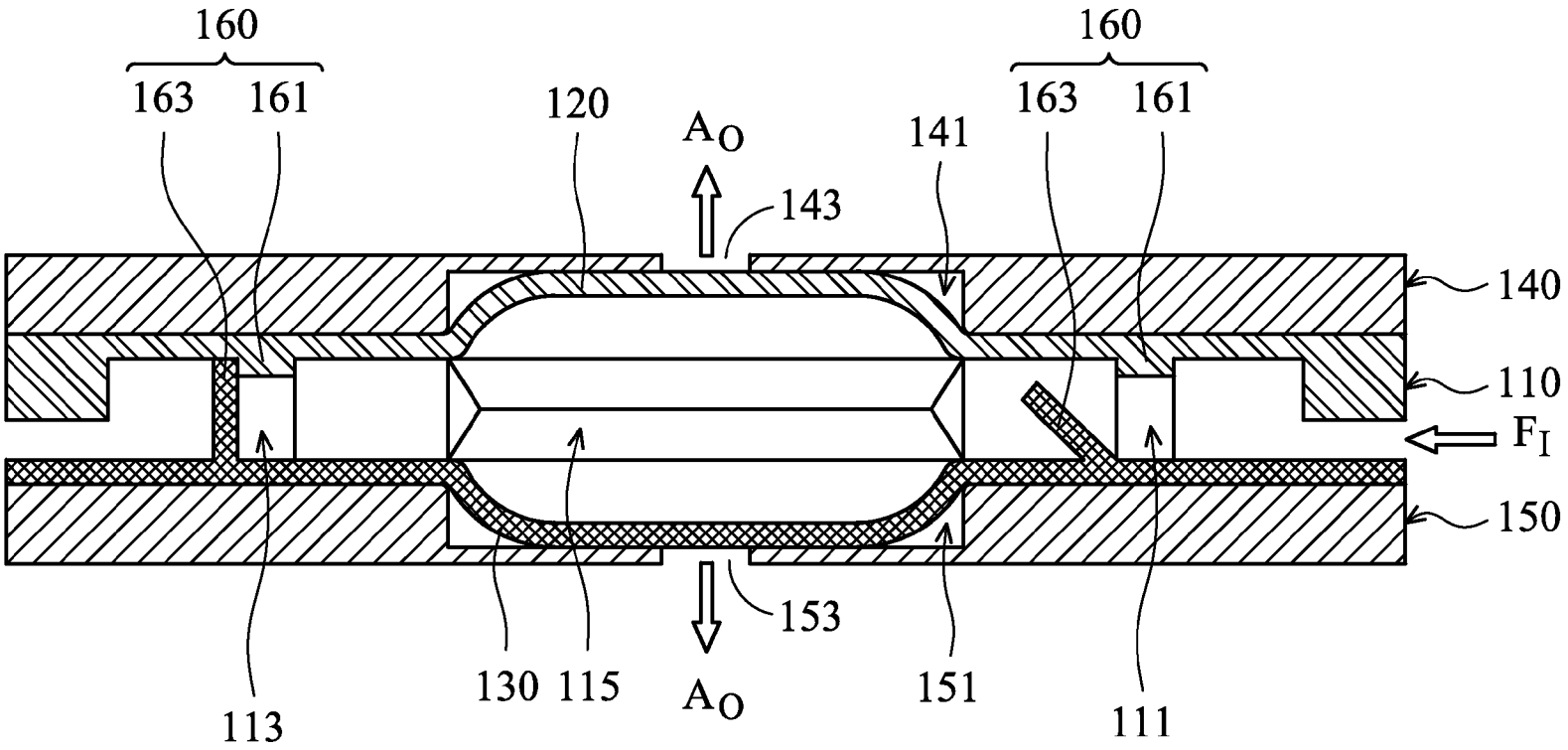
FIGS. 6-7 show cross-sectional views of the pneumatic micropump of the first embodiment of the invention while operating.

The operational method of the pneumatic micropump 100 of the first embodiment of the invention is described as follows. In the PCA therapeutic process, after a patient pushes a trigger button, the pneumatic micropump 100 is actuated. As shown in FIG. 6, the pneumatic channels 143 and 153 respectively apply a vacuum to the upper and lower pneumatic chambers 141 and 151. Due to the elastic nature of the upper and lower membranes 120 and 130, the upper and lower membranes 120 and 130 are deformed in response to the negative pressure in the pneumatic channels 143 and 153. After the upper and lower membranes 120 and 130 are directed into the upper and lower pneumatic chambers 141 and 151, the pressure in the reservoir 115 is reduced, and the fluid from the fluid inlet 111 is flowed into the reservoir 115. It is noted that, impacted by the fluid, the flap 163 in the fluid inlet 111 is pivoted relative to the lower membrane 130, and moves away from the embossed structure 161 formed at the inner wall of the fluid inlet 111; On the contrary, attracted by the negative pressure in the reservoir 115, the flap 163 in the fluid outlet 113 is pulled back, such that the fluid outlet 113 is blocked because the flap 163 is tightly abutted against the embossed structure 161 formed at the inner wall of the fluid outlet 113. Consequently, a large volume of fluid from the fluid inlet 111 can be stored in the reservoir 115, while the body fluid of the patient from the fluid outlet 113 is effectively prevented from flowing into the reservoir 115.

Figure 7:
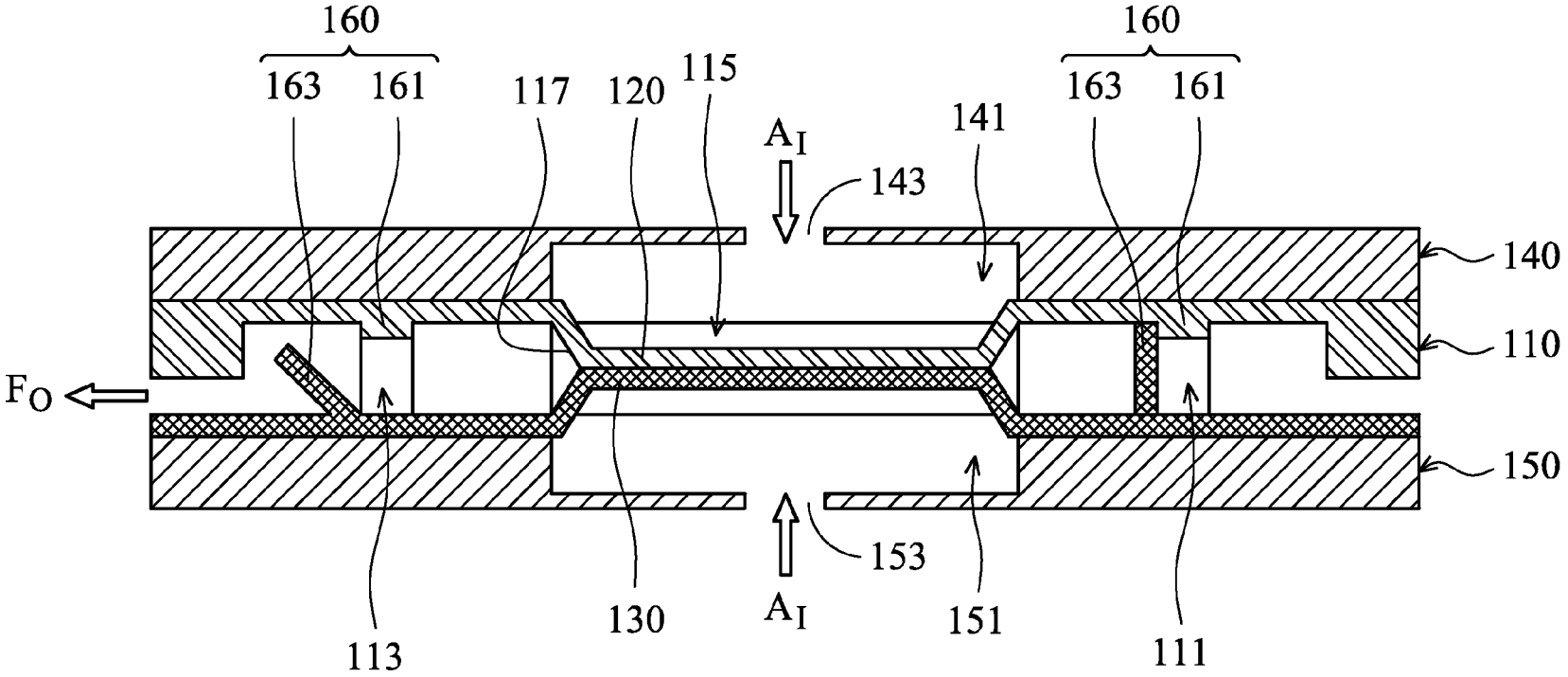

Please refer to FIG. 7, after the reservoir 115 is filled with the fluid, the pneumatic channels 143 and 153 respectively apply a pressure to the upper and lower pneumatic chambers 141 and 151. Due to the elastic nature of the upper and lower membranes 120 and 130, the upper and lower membranes 120 and 130 are deformed in response to the positive pressure in the pneumatic channels 143 and 153. After the upper and lower membranes 120 and 130 are directed into the reservoir 115, the substantial central portions of the upper and lower membranes 120 and 130 contact each other and abut the circular flange 117 formed in the inner wall of the reservoir. To drain off the fluid in the reservoir 115, the upper and lower membranes 120 and 130 are deflected the distance of a half of the fluid width H because the reservoir 115 is disposed therebetween.

It is noted that affected by the kinetic energy of the fluid, the flap 163 in the fluid outlet 113 is pivoted relative to the lower membrane 130, and moves away from the embossed structure 161 formed at the inner wall of the fluid outlet 113. On the other hand, the flap 163 in the fluid inlet 111 is pulled backed, and the fluid inlet 111 is blocked because the flap 163 is tightly abutted against the embossed structure 161 formed at the inner wall of the fluid inlet 111.

Additionally, it is appreciated the structural features of the circular flange 117 of the reservoir 115, the upper and lower membranes 120 and 130 can contact each other and abut the circular flange 117 tightly. Consequently, the fluid in the reservoir 115 can be completely drained off without dead volume so that the patient can receive analgesics according to prescription.

Further, because of the flowing direction of the air in the pneumatic channels 143 and 153 are substantially perpendicular to the extension planes of the upper membranes 120 and 130, the pressure from the pneumatic channels 143 and 153 are directly applied to the upper and lower membranes 120 and 130. But this is not a necessary feature of the invention, and a person skilled in the art is able to adjust the positions of the pneumatic channels 143 and 153 according to different demands.

Figure 8:
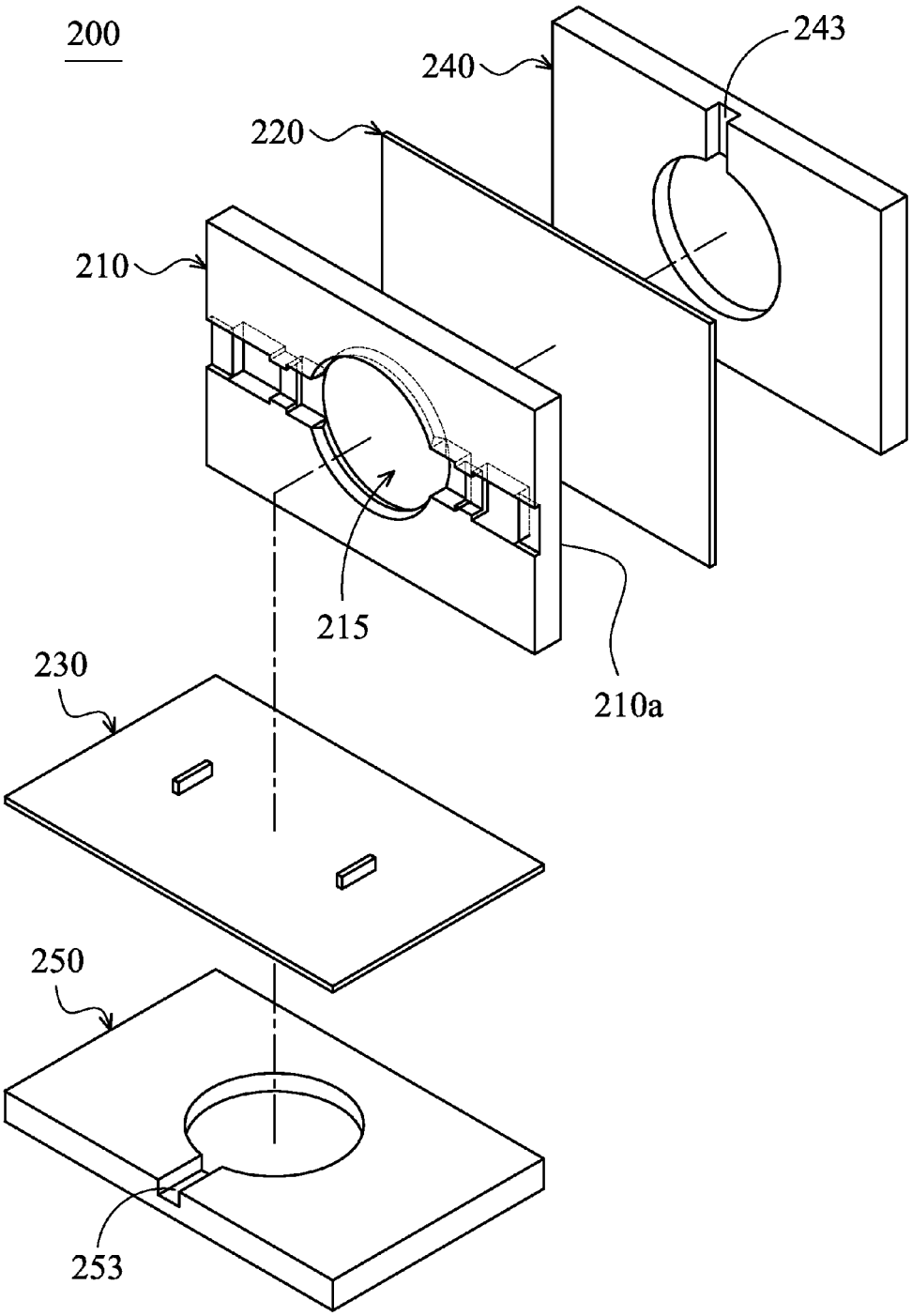
FIG. 8 is an explosive view of a pneumatic micropump of a second embodiment of the invention.

Please refer to FIG. 8. FIG. 8 is an explosive view of the pneumatic micropump 200 of a second embodiment of the invention, wherein elements substantially similar to that of the pneumatic micropump 100 are designated with like reference numbers and explanation that has been given already will be omitted in the following description. The pneumatic micropump 200 differs with the pneumatic micropump 100 in that the central portion of a fluidic channel layer 210 is penetrated by a reservoir 215, and an upper membrane 220 is connected to an upper surface 210*a* of the fluidic channel layer 210. On the other hand, the flowing direction of the air in pneumatic channels 243 and 253 of upper and lower substrates 240 and 250 are parallel to the extension planes of the upper and lower substrates 240 and 250.

In the above mentioned embodiments, the upper and lower membranes are directed into the reservoir or away from the reservoir simultaneously so that the deflection distance of the membranes is reduced, and the life of the membrane is prolonged. A dead volume in the reservoir does not occur due to the circular flange of the reservoir. The flowing direction of the fluid is limited by the valves disposed on the fluid inlet and the fluid outlet; thus, the body fluid of the patient from is prevented from flowing into the inside of the pneumatic micropump Please refer to FIGS. 9A-9D. FIGS. 9A-9D show schematic view of a pneumatic micropump 300 of a third embodiment of the invention, wherein elements substantially similar to that of the pneumatic micropump 100 are designated with like reference numbers and explanation that has been given already will be omitted in the following description. The pneumatic micropump 300 differs with the pneumatic micropump 100 in that the pneumatic micropump 300 includes an upper guiding element 360 and a lower guiding element 370 which substitutes the valves 160 of the pneumatic micropump 100, and a fluid inlet 311, a reservoir 315 and a fluid outlet 313 are formed independently in a fluidic channel layer 310.

Specifically, the upper guiding element 360 is disposed between the fluidic channel layer 310 and an upper membrane 320, and the upper guiding element 360 has a guiding inlet 361 connected to the fluid inlet 311 and a guiding outlet 362 connected to the reservoir 315 to guide the fluid successively flowing through the fluid inlet 311 and the reservoir 315 when the pneumatic micropump 300 is operated. The lower guiding element 370 is disposed between the fluidic channel layer 310 and the lower membrane 330, and the lower guiding element 370 has a guiding inlet 371 connected to the reservoir 315 and a guiding outlet 372 connected to the fluid outlet 313 to guide the fluid successively flowing through the reservoir 315 and the fluid outlet 372 when the pneumatic micropump 300 is operated.

Figure 9A:
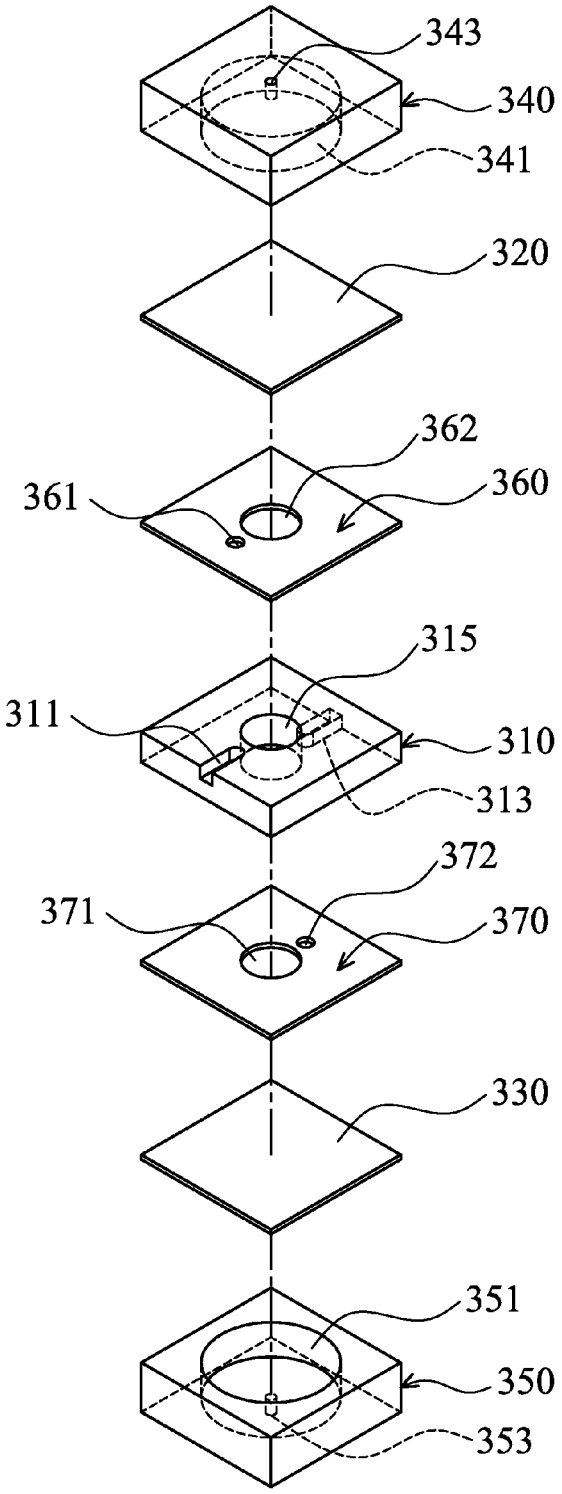
Figure 9B:
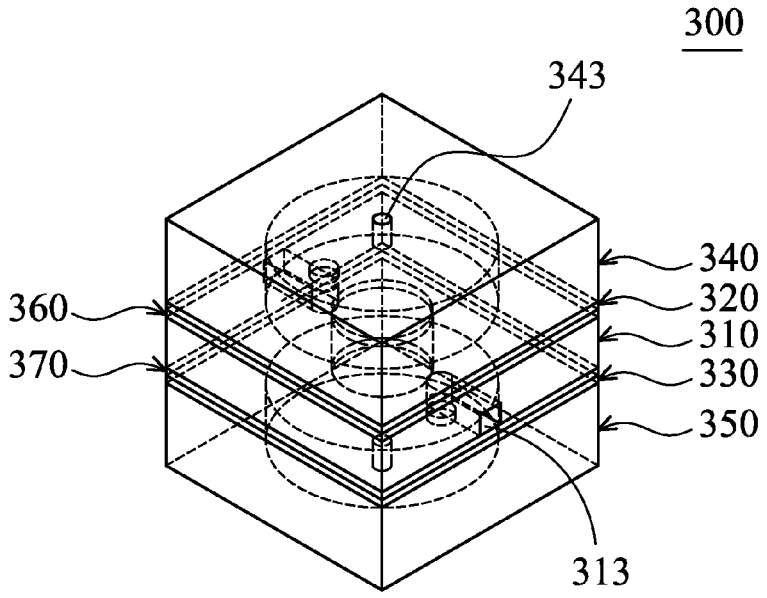
Figure 9C:
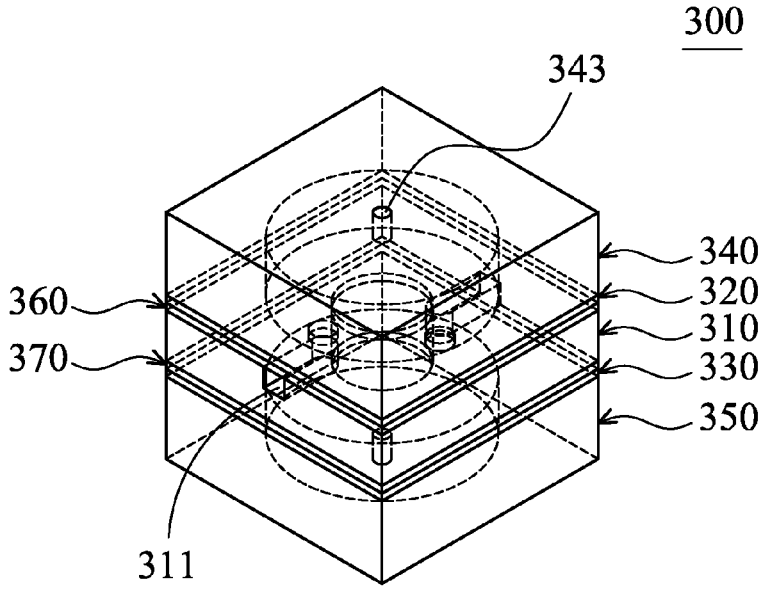
Figure 9D:
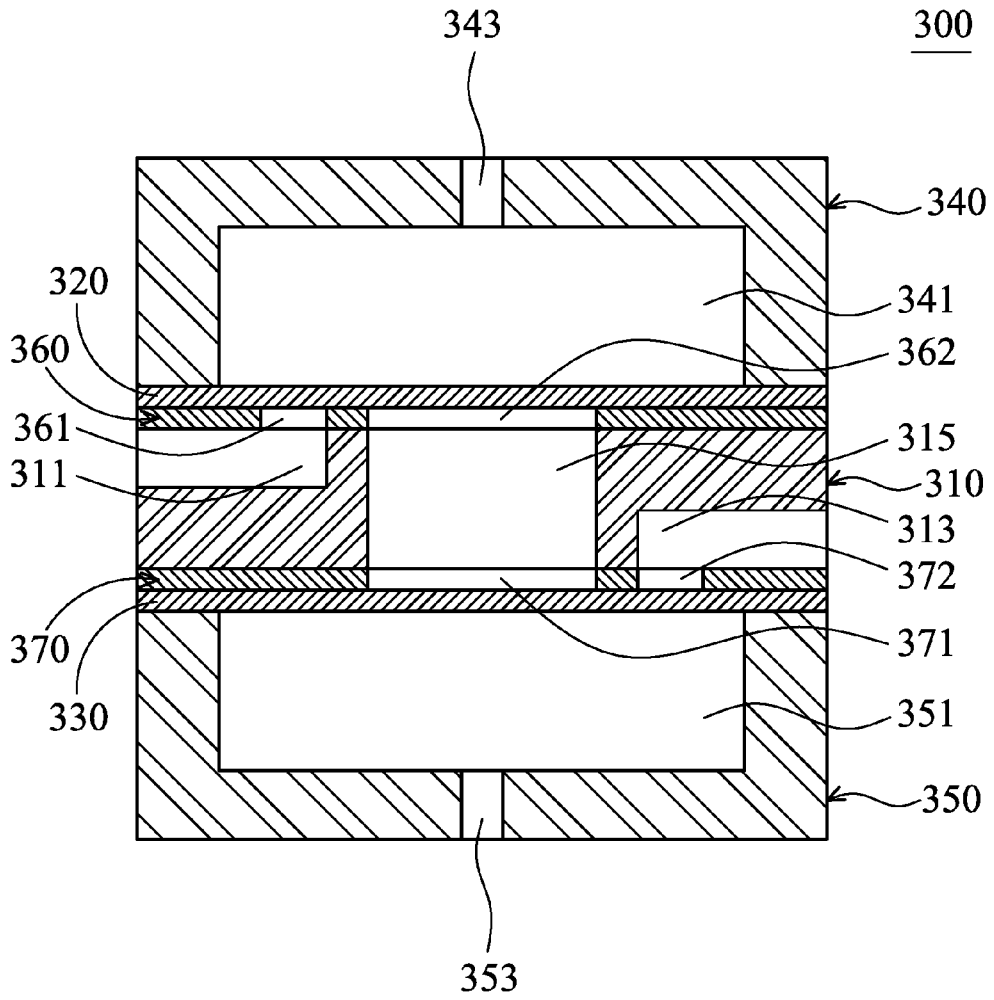

Further, it is noted that the operational method of the pneumatic micropump 300 of the embodiment is not the same as the pneumatic micropump 100 of the first embodiment. In the embodiment, as shown in FIG. 9A, an upper substrate 340 includes an upper pneumatic chamber 341 facing the reservoir 315, and the lower substrate 350 includes a lower pneumatic chamber 351 facing the reservoir 315. The upper pneumatic chamber 341 has a pneumatic channel 343 connecting to an ambient, and the lower pneumatic chamber 351 has a pneumatic channel 353 connecting to an ambient. In the embodiment, the upper membrane 320 and the lower membrane 330 are affected by pressure difference in an upper pneumatic chamber 341 and a lower pneumatic chamber 351 and are directed into the reservoir 315 reciprocally.

Figure 10A:
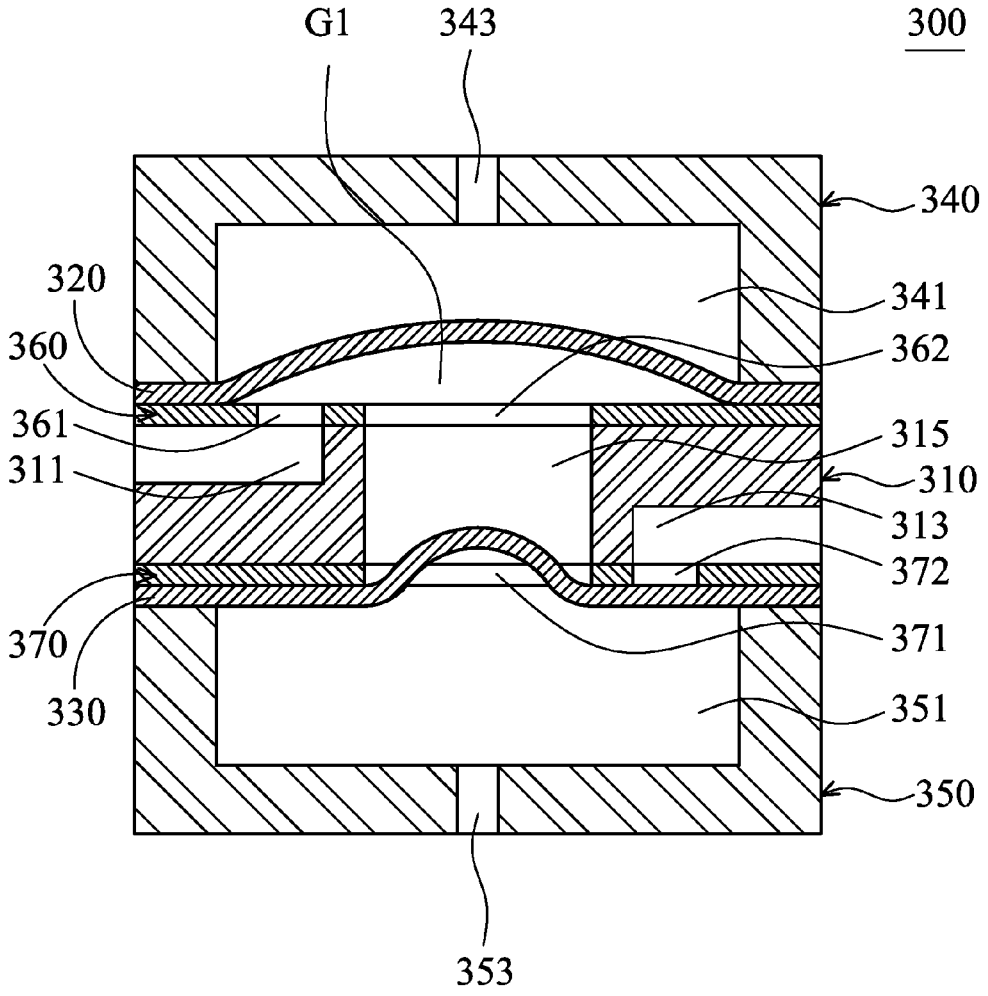
FIGS. 10A-10B show cross-sectional views of the pneumatic micropump of the third embodiment of the invention while operating.
Figure 10B:
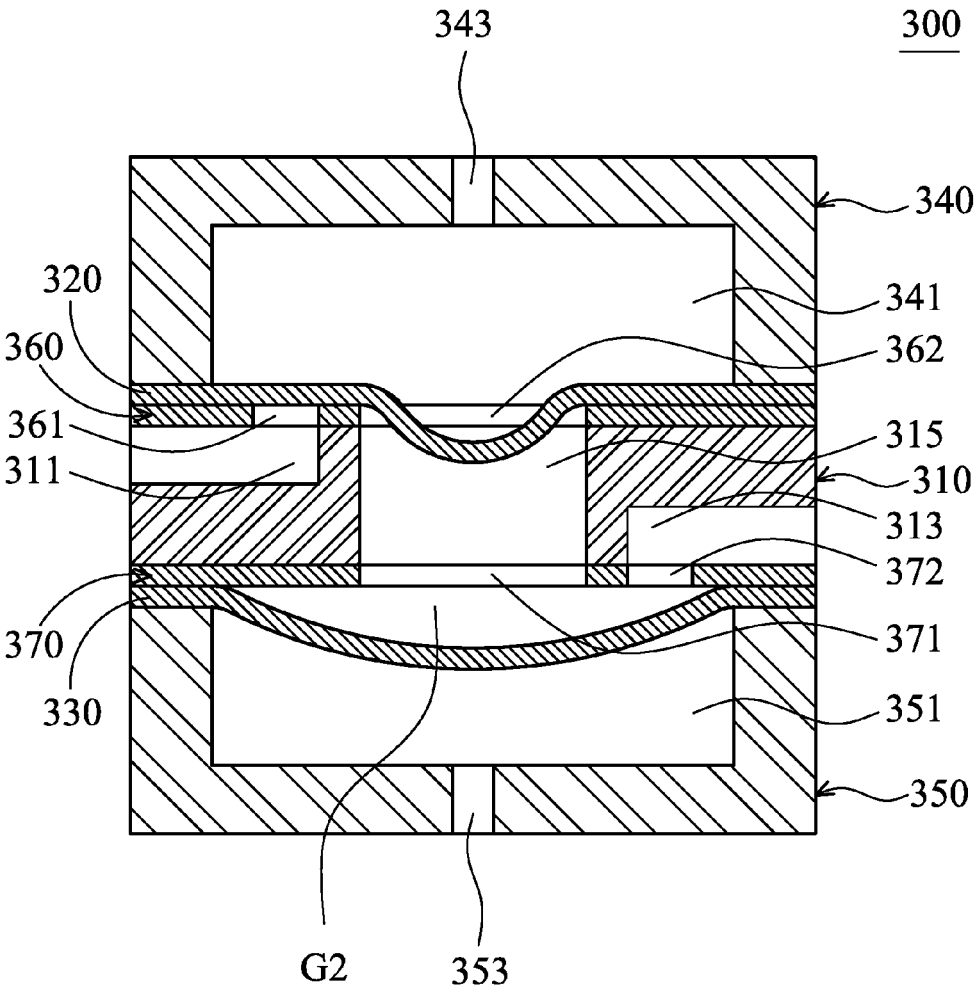

That is, due to a negative pressure suction of the upper pneumatic chamber 341, the upper and lower membrane 320 and 330 are deformed, as shown in FIG. 10A. After the upper membrane 320 is directed into the upper pneumatic chamber 341, the pressure in the reservoir 315 is reduced and the fluid from the fluid inlet 311 flows though the guiding inlet 361 of the upper guiding element 360, a gap G1 resulting from the deformation of the upper membrane 320, and the guiding outlet 362 of the upper guiding element 360 and flows into the reservoir 315. While at the same time, the lower membrane 330 is directed into the reservoir 315 to firmly block the connection between the reservoir 315 and the fluid outlet 313. Next, due to a negative pressure suction of the lower pneumatic chamber 351, the upper and lower membrane 320 and 330 are deformed, as shown in FIG. 10B. After the lower membrane 330 is deflected into the lower pneumatic chamber 351, the upper membrane 320 is deflected into the reservoir 315. The fluid from the reservoir 315 flows though the guiding inlet 371 of the lower guiding element 370, a gap G2 resulting from the deformation of the lower membrane 330, and the guiding outlet 372 of the lower guiding element 370 and flows into the fluid outlet 313. While at the same time, the upper membrane 330 is directed into the reservoir 315 to firmly block the connection between the reservoir 315 and the fluid inlet 311.

In the embodiment, thanks to the structural features, wherein the fluid inlet 311, the reservoir 315, and the fluid outlet 313 are formed independently in the fluidic channel layer 310 and that the upper and lower membranes 320 and 330 are directed into the reservoir 315 reciprocally to block the connections of the fluid inlet 311, the reservoir 315 and the fluid outlet 313, the flowing direction of the fluid can be limited, and bodily fluid from a patient can be prevented from flowing into the pneumatic micropump.

In addition, it is noted that, in the embodiment, the operational method is not limited to having the upper membrane and the lower membrane being directed into the reservoir reciprocally. If the fluid from the fluid inlet 311 successively flows though the guiding inlet 361 and guiding outlet 362 of the upper guiding element 360, the reservoir 315, and the guiding inlet 371 and guiding outlet 372 of the lower guiding element 370 and flows into the fluid outlet 313, the outstanding effects can be achieved. For instance, a vacuum can only be applied to the upper pneumatic chamber 341 or the lower pneumatic chamber 351 to allow the fluid to flow in the pneumatic micropump 300. Alternatively, while a vacuum is applied to the upper pneumatic chamber 341, a pressure can be applied to the lower pneumatic chamber 351 to enhance the flowing rate of the fluid.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A pneumatic micropump comprising:

a fluidic channel layer comprising a fluid inlet, a fluid outlet and a reservoir, wherein a fluid passes through the fluid inlet, the reservoir and the fluid outlet, successively;

an upper substrate comprising an upper pneumatic chamber facing the reservoir;

a lower substrate comprising a lower pneumatic chamber facing the reservoir, wherein the reservoir has a through hole penetrating an upper surface and a lower surface of the fluidic channel layer, and the through hole is arranged along an axis that passes through a center of the upper pneumatic chamber;

an upper membrane disposed between the upper pneumatic chamber and the reservoir; and a lower membrane disposed between the lower pneumatic chamber and the reservoir;

a valve disposed in the fluid inlet or the fluid outlet;

wherein the upper membrane and the lower membrane are independently actuated by the upper pneumatic chamber and the lower pneumatic chamber;

wherein the valve includes an embossed structure formed on a side wall of the fluid inlet or the fluid outlet, and a flap abutting the embossed structure in a separable manner.

2. The pneumatic micropump as claimed in claim 1, wherein along a direction from the fluid inlet to the fluid outlet, the embossed structure and the flap are overlapped to each other.

3. The pneumatic micropump as claimed in claim 1, wherein along a direction from the fluid inlet to the fluid outlet, the embossed structure is disposed in front of the flap.

4. The pneumatic micropump as claimed in claim 1, wherein the fluid inlet and the fluid outlet are respectively defined between the fluidic channel layer and the lower membrane, wherein the flap is disposed on the lower membrane.

5. The pneumatic micropump as claimed in claim 1, wherein the reservoir has a flange formed between the upper membrane and the lower membrane.

6. The pneumatic micropump as claimed in claim 5, wherein the flange encircles an inner wall of the reservoir and has a bottom portion which is connected to the inner wall of the reservoir and a apex portion which is connected to the bottom portion, wherein the bottom portion is wider than the apex portion.

7. The pneumatic micropump as claimed in claim 1, wherein the upper membrane and the fluidic channel layer are formed integrally.

8. The pneumatic micropump as claimed in claim 1, wherein the upper membrane and the lower membrane are directed into the reservoir or away from the reservoir simultaneously.

9. The pneumatic micropump as claimed in claim 1, wherein the upper pneumatic chamber and the lower pneumatic chamber respectively has a pneumatic channel connecting to an ambient.

10. The pneumatic micropump as claimed in claim 1, further comprising:

an upper guiding element, disposed between the fluidic channel layer and the upper membrane; and a lower guiding element, disposed between the fluidic channel layer and the lower membrane.

11. The pneumatic micropump as claimed in claim 10, wherein the upper guiding element has a guiding inlet connected to the fluid inlet and a guiding outlet connected to the reservoir.

12. The pneumatic micropump as claimed in claim 10, wherein the lower guiding element has a guiding inlet connected to the reservoir and a guiding outlet connected to the fluid outlet.

13. The pneumatic micropump as claimed in claim 10, wherein the fluid inlet, the reservoir, and the fluid outlet are formed independently in the fluidic channel layer.

14. The pneumatic micropump as claimed in claim 10, wherein the upper membrane and the lower membrane are affected by pressure difference in the upper pneumatic chamber and the lower pneumatic chamber and are deflected into the reservoir reciprocally.

15. The pneumatic micropump as claimed in claim 1, wherein the upper membrane is connected to the upper surface of the fluidic channel layer, and an upper surface of the upper membrane is coplanar with the upper surface of the fluidic channel layer.

16. A pneumatic micropump comprising:

a fluidic channel layer comprising a fluid inlet, a fluid outlet and a reservoir, wherein a fluid passes through the fluid inlet, the reservoir and the fluid outlet, successively;

an upper substrate comprising an upper pneumatic chamber;

a lower substrate comprising a lower pneumatic chamber, wherein the upper pneumatic chamber, the reservoir, and the lower pneumatic chamber are arranged along an axial direction;

an upper membrane formed integrally with the fluidic channel layer, wherein an upper side of the reservoir which is adjacent to the upper pneumatic chamber is covered by the upper membrane; and a lower membrane disposed between the lower pneumatic chamber and the reservoir;

a valve disposed in the fluid inlet or the fluid outlet;

wherein the upper membrane and the lower membrane are independently actuated by the upper pneumatic chamber and the lower pneumatic chamber;

wherein the valve includes an embossed structure formed on a side wall of the fluid inlet or the fluid outlet, and a flap abutting the embossed structure in a separable manner.

17. The pneumatic micropump as claimed in claim 16, wherein an upper surface of the upper membrane is coplanar with an upper surface of the fluidic channel layer which is directly connected to the upper substrate.

* * * * *